252-95 AU 157 EX
3/18/86 XP 4,576,728

United States Patent [19]
Stoddart

[11] Patent Number: 4,576,728
[45] Date of Patent: Mar. 18, 1986

[54] CLEANING COMPOSITIONS

[75] Inventor: Barry Stoddart, Gateshead, England

[73] Assignee: The Procter & Gamble Company, Cincinnati, Ohio

[21] Appl. No.: 669,492

[22] Filed: Nov. 8, 1984

[30] Foreign Application Priority Data

Nov. 11, 1983 [GB] United Kingdom ..... 8330158

[51] Int. Cl.[4] ..... C11D 1/84; C11D 7/54

[52] U.S. Cl. ..... 252/102; 252/95; 252/108; 252/117; 252/528; 252/546; 252/547; 252/550; 252/551; 252/554; 252/558; 252/DIG. 14

[58] Field of Search ..... 252/95, 99, 102, 547, 252/527, 528, 546, DIG. 14, 108, 117, 550, 551, 554, 558

[56] References Cited

U.S. PATENT DOCUMENTS

| | | | |
|---|---|---|---|
| 3,424,689 | 1/1969 | Kakegawa et al. | 252/89.1 X |
| 3,684,722 | 8/1972 | Hyman et al. | 252/98 |
| 3,876,551 | 4/1975 | Laufer et al. | 252/98 |
| 3,943,234 | 3/1976 | Roggenkamp | 424/343 |
| 4,199,483 | 4/1980 | Jones | 252/559 |
| 4,282,109 | 8/1981 | Citrone et al. | 252/102 |
| 4,337,163 | 6/1982 | Schilp | 252/96 |
| 4,352,678 | 10/1982 | Jones et al. | 51/307 |
| 4,386,004 | 5/1983 | Jenkins | 252/145 |
| 4,474,677 | 10/1984 | Foxlee | 252/98 |

FOREIGN PATENT DOCUMENTS

| | | |
|---|---|---|
| 0021581 | 1/1981 | European Pat. Off. . |
| 0030401 | 6/1981 | European Pat. Off. . |
| 79697 | 5/1983 | European Pat. Off. . |
| 187499 | 11/1983 | Japan . |
| 1082076 | 9/1967 | United Kingdom . |
| 1329086 | 9/1973 | United Kingdom . |
| 2003522 | 3/1979 | United Kingdom . |

OTHER PUBLICATIONS

Formulating with Amine Oxides, M. Weinstein & L. Smith-Household & Personal Products Industry, Jan. 1979, pp. 74, 75 & 85.

*Primary Examiner*—Prince E. Willis
*Attorney, Agent, or Firm*—Richard C. Witte; Ronald L. Hemingway; Leonard Williamson

[57] ABSTRACT

Aqueous cleaning compositions displaying shear thinning behaviour are provided, comprising from 0.1% to 5% by weight $C_{12}$–$C_{15}$ alkyl amine oxides, together with from 0.01 to 1% by weight of an aromatic molecule containing ring substitution in at least two positions, one substituent being a carboxylic acid group. Compositions containing alkali metal hypochlorite bleach are disclosed in which the preferred aromatic molecule is m- or p-chlorobenzoic acid.

18 Claims, No Drawings

CLEANING COMPOSITIONS

FIELD OF THE INVENTION

This invention relates to aqueous cleaning compositions incorporating low levels of amine oxide surfactants and displaying pronounced shear thinning behaviour i.e. exhibiting high viscosities at low rates of shear and much lower viscosities at high rates of shear. This type of behaviour is of particular utility in cleaning compositions intended to be applied "as is" to non-horizontal structural surfaces such as walls, and windows and sanitary fittings such as sinks, baths, showers, wash basins and WCs. The invention is especially concerned with aqueous hypochlorite bleach-containing cleaning compositions which are commonly applied to the surfaces of sanitary fittings.

BACKGROUND TO THE INVENTION

It is well known that the higher the viscosity of a liquid composition, the greater will be its residence time when applied to a non-horizontal surface such as a wall. Viscosity can be increased in many ways e.g. by the use of a polymeric organic thickening agent as a component of the composition, by increasing the concentration of dissolved components, by adding solid components which are suspended in the solution or by modifying the characteristics of the dissolved components to create gel phases.

Each of these approaches has its limitations. A polymeric thickening agent, although of value in compositons that are not exposed to aggressive environments, is not useful where the composition contains a hypochlorite bleach because of the tendency of the hypochlorite to attack the polymer, which leads to the destruction of the latter's thickening capability. Mere increases in the solution concentration of components have a limited effect on solution viscosity and are thus not particularly cost effective. The addition of solid, i.e. non-soluble, components introduces additional complexity, in that settling out or sedimentation on storage has to be avoided, and the physical form of the product is normally limited to an opaque suspension which is not ideal for an aqueous cleaning composition. Modification of the physical characteristics of the dissolved components by interaction to form viscous phases can also introduce limitations on the type and concentration of the components.

In order to overcome the problem of thickener (and bleach) stability, in thickened aqueous hypochlorite-containing compositions, a variety of formulations have been proposed. More of these involve combinations of surfactants that are stable to hypochlorite solution, examples being the compositions disclosed in BP No. 1329086 an BP No. 1418671, European Published Patent Application Nos. 21581 and 30401 and French Pat. No. 2355909. Hypochlorite bleach compositions containing surfactant combinations with product viscosity values of up to $\approx$150 mPa.sec are disclosed by the art but the attainment of higher viscosities than this is not specifically taught and is believed to require surfactant levels that are likely to be unattractive economically.

It has now been found that aqueous solutions of long chain amine oxides in combination with certain aromatic compounds having a carboxylic or hydroxylic functionality and possessing a defined amphiphilic character are capable of pronounced shear thinning behaviour. This results in very high viscosities at the low rates of shear which are produced as a result of the movement of a liquid down a vertical surface under its own weight, whilst giving rise to low viscosities when the solution is dispensed under pressure through a restricted orifice such as the neck of a flexibly sided bottle.

SUMMARY OF THE INVENTION

According to the present invention there is provided a thickened aqueous cleaning composition comprising (a) from about 0.1% to about 5% by weight of a tertiary amine oxide of formula $R_1R_2R_3N\rightarrow O$ wherein $R_1$ is selected from $C_{12}$–$C_{15}$ linear and branched alkyl groups and $R_2$ and $R_3$ are independently selected from $C_1$–$C_4$ alkyl groups and $C_2$–$C_4$ hydroxyl alkyl groups, (b) from about 0.01% to about 1% by weight of a compound selected from salicylic acid and its 5-sulpho- and 3,5-dimethyl derivatives, m- and p-chlorobenzoic acid, p-bromobenzoic acid, m-nitrobenzoic acid and p-toluic acid and mixtures thereof.

(c) from 0% to about 25% by weight of ionisable non surface active organic, or inorganic compounds;

said composition exhibiting a viscosity of at least about 500 mPa.sec at a shear rate of 10.8 $sec^{-1}$ and a viscosity of no more than about 50 mPa.sec at a shear rate of 692 $sec^{-1}$ at 21° C. In this specification viscosity measurements quoting a shear rate are made on a Haake RV12 concentric cylinder viscometer (of the Searle Design) at 21° C. using an NV sensor system.

DETAILED DESCRIPTION OF THE INVENTION

In its broadest aspect the invention comprises an aqueous cleaning composition containing two components viz. a long chain amine oxide and an amphiphilic aromatic molecule of defined functionality.

Amine oxides useful in the present invention have the formula $R_1R_2R_3N\rightarrow O$ wherein $R_1$ is a $C_{12}$–$C_{15}$ alkyl group and $R_2$ and $R_3$ are $C_1$–$C_4$ alkyl groups. The amine oxide is present in an amount of from about 0.1% to about 5%, more preferably from about 0.5% to about 2.5% and, in preferred embodiments of the invention in which the $R_1$ average chain length is about 14 carbon atoms, from about 1% to about 1.5% by weight of the composition. The $R_1$ group may be linear or branched and may be derived from natural or synthetic hydrocarbon sources. For the purposes of the present invention, linear groups are defined as including moieties incorporating up to about 25% methyl branching, predominantly in the 2-position relative to the nitrogen atom of the amine oxide.

Methyl branching on the alkyl chain also predominates in those amine oxides useful in the present invention in which the $R_1$ group is branched, rather than linear in nature. Commercially available sources of these amine oxides are normally a mixture of

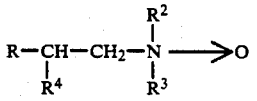

where $R_4$ is methyl, and

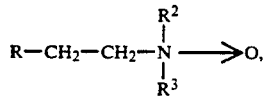

which mixture arises as a result of the processing route used to form the precursor alcohol or aldehyde. This route involves carbonylating or hydroformylating an olefin, preferably a linear α-olefin and leads to a mixture of the desired branched chain aldehyde or alcohol of the same carbon number. For olefin starting materials having a range of carbon chain length, the resultant alcohol or aldehyde mixture contains compounds of different carbon number and isomers containing straight chain and 2-alkyl branched chain alkyl groups. A typical commercially available mixture comprises from about 65 to about 75% by weight $C_{13}$ and from about 35 to about 25% by weight $C_{15}$ amine oxides with approximately 50% by weight straight chain and 50% by weight 2-alkyl branched chain where the 2-alkyl group is predominantly methyl. These are available from ICI under the trade name Synprolam 35 DMO as a 30% aqueous solution. The branched chain amine oxides and mixtures thereof with linear chain amine oxides are used at levels towards the upper end of the range viz. ≧about 2% by weight of the composition and typically from about 2.0% to about 2.5% by weight.

Although the above-described mixture of straight chain and branched chain alkyl dimethyl amine oxides has been found suitable for the purposes of the invention in its broadest aspect, their use is not preferred in the bleaching composition embodiments of the invention. This is because amine oxides in which the long chain alkyl group $R_1$ is linear are more susceptible than those where $R_1$ is non linear to the effect of the viscosity modification agents useful in the present invention. In consequence a bleaching composition containing 8–10% hypochlorite and an amine oxide in which the long chain alkyl group is branched and has a carbon number of about 13.3 requires an ionic strength of at least about 4.7 g moles/dm$^3$ to achieve a product viscosity in excess of >about 200 mPa. sec. This level of ionic strength is believed to make the storage stability of the hypochlorite bleach less than that which is considered desirable for the expected shelf life of the product. The preferred amine oxide structure for 'thickened' products having a viscosity of ≦about 200 mPa. sec. is one in which $R_1$ has an average chain length in the range $C_{14}$–$C_{15}$. Compositions containing these preferred amine oxides require a lower amine oxide level viz. about 2.0% more typically 1.0–1.5%, and also a lower ionic strength viz. about 3.0 g moles/dm$^3$ minimum in order to achieve target viscosity. Both of these reductions in ingredient level lead to improved storage stability and also lower the cost of the product.

The second essential component of the composition of the invention is an aromatic molecule containing ring substitution in at least two positions, one substituent being a carboxylic acid group. With the exception of hydroxy group substitution, the second substituent in the aromatic ring is preferably not in the o-position.

The mode of operation of these materials in the composition of the invention is not understood, although it is believed that they are responsible for some form of association between the amine oxide micelles which leads to the production of a loosely bound structure in solution which displays high viscosity at low shear rates.

Examples of molecules having the desired characteristics are meta- and para-chlorobenzoic acid, meta nitrobenzoic acid, para bromobenzoic acid, salicylic acid, 5-sulphosalicylic acid, 3,5-dimethyl salicylic acid and paratoluic acid. Of the above materials the chlorobenzoic acids are preferred.

The level of use of the aromatic molecule in compositions of the invention is from about 0.01% to about 1% by weight of the composition, more preferably in the range from about 0.05% to about 0.25% by weight, with the most preferred range being from about 0.075% to about 0.2% by weight.

In the broadest aspect of the invention the only essential component other than the amine oxide and the aromatic molecule is water which forms the remainder of the composition. Nevertheless for practical purposes, compositions embodying the present invention will normally contain other, optional, ingredients and in preferred executions of the invention these will include ionisable compounds which may be organic or inorganic in character. These ionisable compounds provide a source of ionic strength (I) which also serves to enhance the viscosity of the compositions. Levels of ionisable inorganic compounds of up to about 25% by weight of the compositon can be utilised corresponding to ionic strengths of up to about 6.5 gmoles/dm$^3$, depending on the compounds employed.

In the aspect of the invention directed to liquid detergent compositions suitable for cleaning hard surfaces such as walls and windows, the ionisable compound can include any of the water soluble inorganic and organic builder and sequestrant salts normally incorporated in such products. Compounds classifiable and well-known in the art as detergent builder salts include the nitrilotriacetates, polycarboxylates, citrates, ortho- and pyrophosphates, and mixtures of any of these. Metal ion sequestrants include all of the above, plus materials like ethylenediaminetetra-acetate, the amino-polyphosphonates and phosphates (DEQUEST). A wide variety of poly-functional organic acids and salts is disclosed in European Patent Application Publication No. 0040882 which is specifically incorporated herein by reference and which contains examples of the use of such materials in various cleaning compositions. In general the builder/sequestrant will comprise from about 1% to about 25% of the composition. Citric acid (2%–20% as sodium citrate) is a preferred builder.

In preferred embodiments of the compositions of the invention the ionisable compounds include a hypochlorite bleach and the alkali metal chloride and chlorate salts which accompany it in commercially available material. These salts provide the majority, and preferably all, of the ionic strength desirable in such compositions. An alkali metal hypochlorite content of from about 9 to about 10% in the composition will normally result in an ionic strength of at least about 3.0 g moles/dm$^3$. Ionic strength values in excess of about 5.0 g moles/dm$^3$ are not desirable because of their adverse influence on the stability of the hypochlorite. Preferably the ionic strength is less than about 4.0 g moles/dm$^3$ and values in the region of from about 3.4 to about 3.8 g moles/dm$^3$ are considered to be optimum where a stable product of viscosity>about 200 mPa. sec. is desired.

The alkali metal hypochlorite may be a lithium, potassium or sodium hypochlorite and the level of hypochlorite in the composition is normally arranged to lie in the range from about 1 to about 12%, preferably from about 5 to about 10% by weight. Customarily hypochlorite bleach compositions contain approximately 6% or 9% hypochlorite by weight. However, the activity of chlorine bleaching compositions is conventionally expressed in terms of the weight percentage of available chlorine in the composition, and the actual weight percentage of bleaching species is arranged to provide the desired level of 'available chlorine'. The preferred hypochlorite species is sodium hypochlorite which contains about 95.3% available chlorine.

Alkali metal hypochlorites are commercially available as aqueous solutions containing from about 10 to about 15% by weight 'available chlorine' and the bulk suppliers normally produce material having available chlorine contents towards the upper end of this range viz. from about 12 to about 14% by weight. These commercially available hypochlorite solutions contain other salts as byproducts or contaminants, more specifically free alkalinity in the form of alkali metal hydroxide and alkali metal carbonate, and alkali metal chloride. Low levels of other species such as sodium chlorate are also believed to be formed during hypochlorite manufacture but their chemical stability is sufficiently low that they have largely decomposed by the time the hypochlorite is employed in product formulations. The levels of the byproduct materials depend on the processing conditions employed in the manufacture of the hypochlorite but in general they fall within the ranges 0.2–1.0% alkali metal hydroxide
0.01–0.1% alkali metal carbonate
10.0–18.0% alkali metal chloride expressed as a weight percentage of the hypochlorite solution as supplied.

As stated hereinbefore, the salts accompanying the hypochlorite bleach provide most if not all of the ionisable species necessary for the ionic strength requirement. However, other non surface active organic or inorganic compounds can be added where necessary to provide an ionic strength in the desired range.

The ionisable compound(s) can be inorganic in nature eg. alkali metal or ammonium hydroxide, sulphate, halide, (particularly chloride), carbonate, nitrate, orthophosphate, pyrophosphate, or polyphosphate, or organic such as formate, acetate or succinate. The ionisable alkali metal compound normally comprises a caustic alkali such as sodium or potassium hydroxide either alone or in admixture with alkali metal salts. For product safety reasons the amount of caustic alkali is normally limited to a value in the range of from about 0.5% to about 2%, more usually from about 0.75% to about 1.5% by weight of the composition.

In the preferred embodiments of the invention inorganic compounds such as silicates and organic compounds incorporating oxidisable groups are avoided because of their tendency to have adverse effects on physical and/or chemical stability of the compositions on storage. Certain organic sequestrants such as the amino poly(alkylene phosphonates) salts can, however, be incorporated in an oxidised form in which they are not susceptible to attack by the hypochlorite bleach. Such sequestrants are normally present in amounts of from about 0.1% to about 0.5% by weight of the composition.

The ionic strength of the composition is calculated by means of the expression $$\text{Total Ionic Strength } I = \frac{\Sigma C_i Z_i^2}{2}$$

where $C_i$ is the molar concentration of the ionic species in g moles/dm$^3$ $Z_i$ is the valency of the species.

The function $C_i Z^2_i$ is calculated for each of the ionic species in solution, these functions are summed and divided by two to give the composition ionic strength.

Another optional component of compositions of the present invention is an anionic surfactant. Suitable anionic surfactants are those incorporating an aliphatic hydrocarbyl moiety having an average carbon chain length of more than about 12 and less than about 18 atoms, said moiety comprising at least about 40% by weight of the anionic surfactant. Suitable anionic surfactants satisfying this constraint include alkanoates, $C_1$–$C_5$ alkyl esters of αsulphonated alkanoic acids, olefin sulphonates, alkyl benzene sulphonates in which the alkyl group contains 11–13 carbon atoms, s-$C_{12}$–$C_{18}$ alkane sulphonates, $C_{12}$–$C_{16}$ alkyl sulphates, certain alkyl polyethoxy sulphates, alkyl phosphates and certain alkyl ether phosphates. Mixtures of any of these surfactants can also be employed if desired.

Preferred alkanoates are the $C_{12}$–$C_{14}$ alkali metal or alkaline earth metal soaps and mixtures thereof derived from e.g. coconut or palm kernel oils. The preferred sulphonated alkanoic acid esters are alkali metal sulphonate salts of methyl, ethyl, propyl and butyl esters of $C_{12}$–$C_{14}$ alkanoic acids. Preferred olefin sulphonates are the alkali metal $C_{12-C14}$ αolefin sulphonates and the alkyl benzene sulphonates are preferably those with a linear alkyl chain. The alkyl sulphates may be primary or secondary in type, the alkyl group being derived from primary or secondary alcohols. In turn these alcohols may be derived from any of the sources described above in connection with the long chain group of the amine oxide. The average number of ethoxy groups in the alkyl polyethoxysulphates should not exceed about 3 per mole where the alkyl chain length is from about 12 to about 14 carbon atoms and about 4 per mole where the alkyl chain length is from about 14 to about 16 carbon atoms.

The cation is normally alkali metal, such as sodium, potassium, lithium, or ammonium, although for certain surfactants, alkaline earth metals such as magnesium can also be used.

Preferred anionic surfactants are primary $C_{12}$–$C_{16}$ alkyl sulphates with up to approximately 50% methyl branching, s-$C_{13}$–$C_{15}$ alkane sulphonates and $C_{11}$–$C_{13}$ alkyl benzene sulphonates. Soaps are also preferred anionic surfactants in mixtures in which the amine oxide:anionic surfactant weight ratio is >20:1. Where anionic surfactants are incorporated as components of the compositions of the invention, their level of use is such as to comprise from about 0.1% to about 20% by weight of the mixture of anionic surfactants and amine oxides, the latter comprising the remaining 80% to 99% of the mixture.

Another surfactant which can be incorporated in the compositions of the invention and which is also stable to hypochlorite solutions is a substituted betaine of formula $$R_5R_6R_7N^+—R_8COO^-$$

wherein $R_5$ is a $C_8$–$C_{18}$ alkyl group, preferably a $C_{10}$–$C_{14}$ alkyl group, $R_6$ and $R_7$ are $C_1$–$C_{14}$ alkyl groups, more preferably methyl groups, and $R_8$ is a $C_1$–$C_4$ alkylene group more preferably a $C_2$–$C_3$ alkylene group. Specific examples include octyl, decyl, dodecyl, tetradecyl and hexdecyl betaines in which $R_8$ is an ethylene or propylene group and $R_6$ and $R_7$ are methyl groups. This surfactant can be included at levels up to about 100% of the level of the amine oxide but for cost reasons is normally incorporated at a lower level, preferably at less than about 50%, most preferably at less than about 25% of the level of the amine oxide.

A highly preferred optional component for use in the bleach-containing embodiments of the present invention is a quaternised alkoxy silane which confers a long lasting antibacterial effect on surfaces, particularly siliceous surfaces washed with the compositions. Compositions containing the organosilicon quaternary compounds are preferably free of anionic surfactants in order to avoid interaction between the two components. Where anionic surfactants are present they should comprise less than the molar amount of organosilicon quaternary compound in order to maintain the cationic character of the latter.

Organosilicon quaternary ammonium compounds having the desired combination of broad spectrum antibacterial activity and physico-chemical stability in the cleaning compositions of the invention have the general structure:

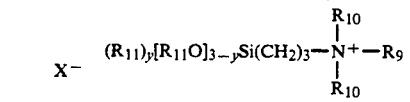

wherein $R_9$ is $C_{16}$–$C_{20}$ alkyl, $R_{10}$ is $C_1$–$C_4$ alkyl, $R_{11}$ is $C_1$–$C_4$ alkyl, y is an integer from 0 to 2, and $X^-$ is a water soluble anion. A preferred chain length for $R_9$ is $C_{18}$ for antibacterial efficacy reasons, and for reasons of cost and ease of preparation $R_{10}$ and $R_{11}$ are usually methyl. In aqueous alkaline solution the $(R_{11}O)$ groups will hydrolyse to give the silanol derivative so that references herein to the organic silicon quaternary ammonium compound include the silanol derivative thereof. $X^-$ is normally halide, particularly chloride, but can also include methosulphate, acetate or phosphate.

The level of incorporation of the organosilicon compound is from about 0.001% to about 0.25% based on the total weight of the composition but is more usually in the range of from about 0.005% to about 0.05% and most preferably from about 0.01% to about 0.03% by weight.

A desirable optional component of compositions in accordance with the invention is a perfume which is present at a level of from about 0.01% to about 0.5% preferably from about 0.05% to about 0.25% by weight of the composition.

Monocyclic and bicyclic monoterpene alcohols and their esters with $C_2$–$C_3$ alkanoic acids are known and used as ingredients in fragrances, including those employed in detergent compositions. As such their level of incorporation varies from about 10 to about 500 ppm of the composition depending on the perfume formulation and the nature of the detergent composition.

The Applicants have found that in aqueous hypochlorite bleach solutions containing from about 1.0% to about 2.5% of a $C_{14}$–$C_{16}$ amine oxide as the only surfactant, the incorporation of at least about 400 ppm of at least one monocyclic or bicyclic monoterpene alcohol or the ester thereof with $C_2$–$C_3$ alkanoic acid provides an enhancement of the viscosity of the bleach solution and facilitates the generation of viscosities of 200 mPa sec. and greater at 20° C. Preferably the monoterpene alcohol or ester is present in an amount of at least about 600 ppm. Examples of materials demonstrating this effect are isoborneol, isobornyl acetate, dihydroterpineol and dihydroterpinyl acetate.

The mode of operation of these materials in this system is not fully understood but it is hypothesised that in the absence of anionic surfactants hydrogen bonding occurs between adjacent alcohol functions of the relatively water insoluble terpene alcohols held in the amine oxide micelles. This leads to the formation of an extended micellar structure in the solution which provides an increased viscosity.

Thickened aqueous hypochlorite bleach compositions in accordance with the present invention and including the above mentioned terpene alcohol derivatives are particularly preferred for the incorporation of quaternised alkoxy silane as an antibacterial component. Such compositions utilise the minimum amounts of amine oxide surfactant and ionic salts necessary to generate the desired product viscosity and hence enhance the stability of the quaternised alkoxy silanes.

The compositions can be made by conventional mixing techniques but, because of the relatively low aqueous solubility of the aromatic viscosity enhancing compound, the amine oxide should be present in the solution to which the viscosity enhancing compound is added. In the preferred compositions the following method of preparation is highly preferred, in order to ensure that problems of incomplete solution, and/or precipitation on storage, do not arise.

In the preferred mode of preparation, a premix of the amine oxide, perfume, added caustic alkali and water is formed at ambient temperature (viz. 15°–25° C.) and the aromatic viscosity enhancing compound is then added with vigorous agitation. Where an organosilicon compound is included it will also be added to the premix with the aromatic viscosity enhancing compound. In the preferred thickened bleach compositions incorporating a monocyclic or bicyclic monoterpene alcohol component this can conveniently be incorporated in the perfume mixture. The premix is then added to a solution of the remaining ingredients e.g. hypochlorite, other surfactants, ionisable inorganic or organic compounds, chelants, etc. to make the final product.

The invention is illustrated in the following examples in which percentages are expressed by weight of the composition unless otherwise stated.

EXAMPLE 1

420 g of a 30% solution of $C_{14}$ linear alkyl dimethyl amine oxide was added to 3555.6 g of demineralised water and 15.0 g of a perfume material containing 7.68 g of isobornyl acetate was dispersed therein. To this solution was slowly added, with vigorous agitation, 12.5 g of p-chlorobenzoic acid as a crystalline powder to form a premix solution. 125 g of solid sodium hydroxide was dissolved in 5875 g of sodium hypochlorite solution (15.3% $AvCl_2$ solution supplied by ICI Ltd) and 4000 g of the premix was then blended with high shear agitation into this solution.

This composition had the following analysis, in percent by weight and had a density of 1.15 g/cm$^2$.

| | | | |
|---|---|---|---|
| NaOCl | 9.43 | (= 9.9% AvCl$_2$) | 1.46 g moles/dm$^3$ |
| NaCl | 9.40 | | 1.84 g moles/dm$^3$ |
| NaOH | 1.25 | | 0.36 g moles/dm$^3$ |
| Amine Oxide | 1.26 | | |
| p-chloro benzoic acid* | 0.125 | | |
| Perfume | 0.150** | | |
| Water & Misc | 78.385 | | |
| | 100.000 | | |

*Added as the acid
**Incorporating a mixture of monoterpene alcohols and esters thereof in an amount corresponding to 1100 ppm on a composition basis.

The ionic strength of this composition was calculated to be 3.66.

This product was a single phase solution having a dynamic viscosity of $\eta$397 mPa sec. as measured at 20° C. with a Brookfield viscometer using the No. 3 spindle at 100 rpm on product that was 24 hours old. Using the HAAKE RV12 viscometer at 21° C. to measure the shear thinning effect provided by the composition, the following values were obtained;

986 mPa.sec @ 1.082 sec$^{-1}$
764 mPa.sec @ 10.82 sec$^{-1}$
30 mPa.sec @ 692.48 sec$^{-1}$ A comparative composition was also produced, using the same preparative procedure but omitting the p chloro benzoic acid. Viscosity measurements at 21° C. using the HAAKE viscometer resulted in the following values 460 mPa. sec @ 1.082 sec$^{-1}$
400 mPa. sec @ 10.82 sec$^{-1}$
35 mPa. sec. @ 692.48 sec$^{-1}$

EXAMPLE 2

Using the technique of Example 1 a composition having the following analysis was prepared:

| | | |
|---|---|---|
| NaOCl | 9.0 | |
| NaCl | 9.0 | |
| NaOH | 1.2 | |
| Linear alkyl dimethyl C$_{14}$ Amine oxide | 1.1 | |
| p chlorobenzoic acid | 0.1 | |
| quaternised alkoxy silane* | 0.02 | |
| Perfume** | 0.125 | (including 0.064 g isobornyl acetate) |
| Water & Misc. | 79.455 | |
| | 100.000 | |

*3(trimethoxysilyl) propyl dimethyl octadecyl ammonium chloride (available from Dow Corning Ltd. as DC 5700)
The quaternised alkoxysilane was added to the premix with the p chlorobenzoic acid.
**Incorporating a mixture of monoterpene alcohols and esters thereof in an amount corresponding to approximately 950 ppm on a composition basis.

The viscosity of this composition was measured 24 hours after manufacture using the HAAKE viscometer at 21° C. and the following values obtained 700 mPa sec @ 1.082 sec$^{-1}$
524 mPa sec @ 10.82 sec$^{-1}$
31 mPa sec @ 692.48 sec$^{-1}$

I claim:

1. A thickened aqueous cleaning composition consisting essentially of (a) from about 0.1% to about 5% by weight of a tertiary amine oxide of formula $R_1R_2R_3N—O$ wherein $R_1$ is a $C_{12}$–$C_{15}$ linear and branched alkyl groups and $R_2$ and $R_3$ are independently selected from the group consisting of $C_1$–$C_4$ alkyl groups and $C_2$–$C_4$ hydroxyl alkyl groups;

(b) from about 0.01% to about 1% by weight of a viscosity enhancing compound selected from the group consisting of [salicylic acid and its 5-sulpho and 3,5-dimethyl derivatives,] m- and p-chloro benzoic acid, p-bromobenzoic acid, p-toluic acid and m-nitrobenzoic acid, and mixtures of any of the foregoing;

(c) from 0% to about 25% by weight of an ionisable compound selected from the group consisting of non surface active organic and inorganic compounds;

said composition exhibiting a viscosity of at least about 500 mPa.sec at a shear rate of 10.8 sec$^{-1}$ and a viscosity of no more than about 50 mPa sec at a shear rate of 692 sec$^{-1}$ at 21° C.

2. A thickened aqueous cleaning composition according to claim 1 wherein component (b) is present in an amount of from about 0.05% to about 0.25% by weight.

3. A thickened aqueous cleaning composition according to claim 2 wherein component (b) is present in an amount of from about 0.075%. to about 0.20% by weight.

4. A thickened aqueous cleaning composition according to claim 2 wherein component (b) is selected from m- and p-chlorobenzoic acids.

5. A thickened aqueous cleaning composition according to claim 2 wherein the ionisable compound (c) is selected from the group consisting of alkali metal and ammonium citrate, formate, acetate, succinate, hydroxide, sulphate, halide, carbonate, nitrate, orthophosphate, pyrophosphate, polyphosphate, amino polycarboxylate, amino polyphosphonate and mixtures of any thereof.

6. A thickened aqueous cleaning composition consisting essentially of (a) from about 0.1% to about 5% by weight of a tertiary amine oxide of formula $R_1R_2R_3N—O$ wherein $R_1$ is a $C_{12}$–$C_{15}$ linear and branched alkyl groups and $R_2$ and $R_3$ are independently selected from the group consisting of $C_1$–$C_4$ alkyl groups and $C_2$–$C_4$ hydroxyl alkyl groups;

(b) from about 0.01% to about 1% by weight of a viscosity enhancing compound selected from the group consisting of [salicylic acid and its 5-sulpho and 3,5-dimethyl derivatives,] m- and p-chloro benzoic acid, p-bromobenzoic acid, p-toluic acid and m-nitrobenzoic acid, and mixtures of any of the foregoing;

(c) from 0% to about 25% by weight of an ionisable compound selected from the group consisting of non surface active organic and inorganic compounds;

(d) an auxiliary surfactant in an amount not exceeding about 100% by weight of amine oxide present;

said composition exhibiting a viscosity of at least about 500 mPa.sec at a shear rate of 10.8 sec$^{-1}$ and a viscosity of no more than about 50 mPa sec at a shear rate of 692 sec$^{-1}$ at 21° C.

7. A thickened aqueous cleaning composition according to claim 6 wherein the auxiliary surfactant is a betaine of formula $$R_5R_6R_7N^+—R_8COO^-$$

wherein $R_5$ is a $C_8$–$C_{18}$ alkyl group, $R_6$ and $R_7$ are $C_1$–$C_4$ alkyl groups, and $R_8$ is a $C_1$–$C_4$ alkylene group.

8. A thickened aqueous cleaning composition according to claim 6 wherein the auxiliary surfactant is an anionic surfactant selected from the group consisting of alkali and alkaline earth metal alkanoates, $C_{11}$–$C_{13}$ alkyl benzene sulphonates, s-$C_{12}$–$C_{18}$-alkane sulphonates, $C_{12}$–$C_{16}$ alkyl sulphates and ethoxylated derivatives thereof containing not more than four ethoxy groups per mole, and mixtures of any of the foregoing, the auxiliary surfactant being present in an amount of from about 0.1% to about 20% by weight of the mixture of amine oxide and anionic surfactants.

9. A thickened aqueous cleaning composition according to claim 1 wherein the amine oxide is the sole surfactant species present.

10. A thickened aqueous cleaning composition according to claim 9 wherein component (b) is present in an amount of from about 0.05% to about 0.25% by weight.

11. A thickened aqueous cleaning composition according to claim 10 wherein component (b) is present in an amount of from about 0.075% to about 0.20% by weight.

12. A thickened aqueous cleaning composition according to claim 10 wherein component (b) is selected from m- and p-chlorobenzoic acids.

13. A thickened aqueous cleaning composition according to claim 10 wherein $R_1$ is a linear alkyl group having an average carbon chain length in the range $C_{14}$–$C_{15}$.

14. A thickened aqueous cleaning composition according to claim 13 wherein component (c) provides an ionic strength of not more than about 5.0 g moles/$dm^3$.

15. A thickened aqueous cleaning composition according to claim 13 wherein component (c) comprises a mixture of sodium hypochlorite, sodium chloride and sodium hydroxide.

16. A thickened aqueous cleaning composition according to claim 15 wherein the hypochlorite is present in an amount from about 1 to about 10% by weight, the sodium chloride is present in an amount of from about 1 to about 10% by weight and the sodium hydroxide is present in an amount of from about 0.5% to about 1.5% by weight.

17. A thickened aqueous cleaning composition according to claim 9 incorporating at least about 400 ppm of a compound selected from the group consisting of monocyclic and bicyclic monoterpene alcohols, esters thereof with a $C_2$–$C_3$ alkanoic acids and mixtures of any of the foregoing.

18. A thickened aqueous bleaching composition consisting essentially of (a) from about 1% to about 1.5% by weight of a tertiary amine oxide of formula $R_1R_2R_3N{\rightarrow}O$ wherein $R_1$ is a linear or substantially linear alkyl group containing an average of 14–15 carbon atoms, and $R_2$ and $R_3$ are methyl groups, said amine oxide constituting the sole surfactant species present in the composition;

(b) from about 0.075% to about 0.20% of p-chlorobenzoic acid;

(c) from about 1% to about 10% by weight of sodium hypochlorite, from about 1% to about 10% by weight of sodium chloride and from about 0.5% to about 1.5% by weight of sodium hydroxide said hypochlorite, chloride and hydroxide providing an ionic strength not exceeding about 4.0 g moles/$dm^3$;

(d) at least about 600 ppm of a compound selected from the group consisting of monocyclic and bicyclic monoterpene alcohols, esters thereof with $C_2$–$C_3$ alkanoic acids, and mixtures of any thereof (e) from 0% to about 0.25% of a quaternised alkoxy silane having the general formula $$(R_{11})_y[R_{11}O]_{3-y}Si(CH_2)_3-\overset{\overset{R_{10}}{|}}{\underset{\underset{R_{10}}{|}}{N^+}}-R_9 \quad X^-$$

wherein $R_9$ is $C_{16}$–$C_{20}$ alkyl, $R_{10}$ is $C_1$–$C_4$ alkyl, $R_{11}$ is $C_1$–$C_4$ alkyl, y is an integer from 0 to 2, and $X^-$ is a water soluble anion.

* * * * *

UNITED STATES PATENT AND TRADEMARK OFFICE

CERTIFICATE OF CORRECTION

PATENT NO. : 4,576,728
DATED : March 18, 1986
INVENTOR(S) : Barry Stoddart

It is certified that error appears in the above-identified patent and that said Letters Patent are hereby corrected as shown below:

Col. 10, lines 3-4 delete "[salicylic acid and its 5-sulpho and 3,5-dimethyl derivatives,]".

Col. 10, lines 45-46 delete "[salicylic acid and its 5-sulpho and 3,5-dimethyl derivatives,]".

Signed and Sealed this

Fourteenth Day of October, 1986

[SEAL]

*Attest:*

DONALD J. QUIGG

*Attesting Officer*

*Commissioner of Patents and Trademarks*